United States Patent [19]

Schmid et al.

[11] 4,454,959

[45] Jun. 19, 1984

[54] TRANSPORT CONTAINER FOR TRANSPORTING HOT PARTICULATE MATERIALS

[75] Inventors: Karl Schmid, Essen; Bernhard Heinrichs, Wattenscheid, both of Fed. Rep. of Germany

[73] Assignee: Krupp-Koppers GmbH, Essen, Fed. Rep. of Germany

[21] Appl. No.: 352,842

[22] Filed: Feb. 26, 1982

[30] Foreign Application Priority Data

Mar. 4, 1981 [DE] Fed. Rep. of Germany ..... 3108149

[51] Int. Cl.[3] ..... B65D 90/04

[52] U.S. Cl. ..... 220/400; 52/249; 220/468

[58] Field of Search ..... 220/468, 5 A, 1 B, 400; 52/80, 518, 546, 550, 245–249, 385; 110/336; 202/96; 432/264

[56] References Cited

U.S. PATENT DOCUMENTS

| | | | |
|---|---|---|---|
| 280,470 | 7/1883 | Hayes | 220/468 X |
| 1,169,205 | 1/1916 | Stout | 206/524.3 X |
| 1,259,320 | 3/1918 | Tyler | 220/468 X |
| 1,422,900 | 7/1922 | Strong | 220/5 A X |
| 1,896,829 | 2/1933 | Roos | 206/524.3 |
| 2,092,408 | 9/1937 | Smith | 52/426 |
| 2,230,142 | 1/1941 | Longacre | 52/249 X |
| 2,677,337 | 5/1954 | Neuhausen | 52/526 |
| 2,705,414 | 4/1955 | Rose | 220/468 X |
| 2,942,454 | 6/1960 | Jackson | 52/249 |
| 3,015,193 | 1/1962 | Amoruso | 52/546 |
| 3,226,896 | 1/1966 | Bothe et al. | 52/518 X |
| 3,339,778 | 9/1967 | Herrenschmidt | 220/436 |
| 3,458,641 | 7/1969 | Perucchetti | 52/249 X |
| 4,064,664 | 12/1977 | Gaul | 52/385 X |
| 4,112,648 | 9/1978 | Suzuki et al. | 52/249 X |
| 4,197,834 | 4/1980 | Nevins | 52/518 X |

FOREIGN PATENT DOCUMENTS

| | | | |
|---|---|---|---|
| 43-17062 | 7/1968 | Japan | 432/264 |
| 50-39811 | 9/1975 | Japan | 220/5 A |
| 2067644 | 7/1981 | United Kingdom | 220/5 A |

*Primary Examiner*—Allan N. Shoap
*Assistant Examiner*—Robert Petrik
*Attorney, Agent, or Firm*—Michael J. Striker

[57] ABSTRACT

A transport container for transporting hot particulate materials, particularly coke, has a wall bounding an inner chamber for accommodating a hot particulate material and having an inner side, a coating arranged at the inner side of the wall and composed of a plurality of coating members, and holding elements provided on the inner side of the wall and having a plurality of openings, so that each of the coating members releasably engages in a respective one of the openings and is thereby held by the holding elements, so as to coat the inner side of the wall.

12 Claims, 3 Drawing Figures

TRANSPORT CONTAINER FOR TRANSPORTING HOT PARTICULATE MATERIALS

BACKGROUND OF THE INVENTION

The present invention relates to a transport container for transporting hot coke.

Transport containers of this general type are known in the art. A known transport container for transporting hot coke is provided with an inner coating at the inner side of its wall. The containers are utilized for example for transporting hot coke from coke ovens to a cooling shaft of a coke dry-cooling device. The inner lining of such containers is composed, because of high temperatures of the magnitude of approximately 1000° C., of a suitable refractory ceramic material. When the transport container is filled with hot coke, the refractory ceramic material is subjected to high mechanical and thermal loads. The linings do not have a long service life, particularly because of the mechanical loading by the falling hot coke. The lining is additionally subjected to a thermal pressure which further reduces the mechanical strength of the conventional refractory materials. Damage which takes place in the lining as a result of the above mentioned factors can be repaired with the utilization of suitable ceramic stamping or spraying masses. These repairs are, however, extremely time-consuming, inasmuch as they require considerable stoppages for cooling of the lining and the subsequent drying of the repaired part.

SUMMARY OF THE INVENTION

Accordingly, it is an object of the present invention to provide a transport container for hot coke, which avoids the disadvantages of the prior art.

More particularly, it is an object of the present invention to provide a transport container for hot coke, which has an improved lining in that it not only has a considerably longer service life, but also allows cost-economical, simple and fast repairs to the same.

In keeping with these objects, and with others which will become apparent hereinafter, one feature of the present invention resides, briefly stated, in a transport container for transporting hot coke, which has a wall bounding an inner chamber for accommodating a hot particulate material and having an inner side, a lining arranged at the inner side of the wall and composed of a plurality of lining members, and holding means provided on the inner side of the wall and having a plurality of openings, so that each of the lining members releasably engages in a respective one of the openings and is thereby held by the holding means, so as to completely coat the inner side of the wall.

When the transport container is designed in accordance with the present invention, the thus formed lining has a longer service life, and the individual lining members can be easily and inexpensive repaired.

In accordance with another feature of the present invention, the holding means includes a plurality of holding members located under each other and extending in a transverse direction, and the above mentioned openings are formed in each of the holding members spaced from one another in the transverse direction.

More particularly, the holding means may be formed as steel strips which are closed, or particularly circumferentially closed.

In accordance with still another feature of the present invention, each holding member is provided with a projection which engages in the opening of the respective holding member so that the coating members are arranged on the holding members in suspended condition. The above mentioned projections are provided at a rear side of each lining member, facing toward the wall.

Still a further feature of the present invention is that the lining members are formed as lining plates composed of hematite cast iron.

Finally, a further feature of the present invention is that the openings of the holding means may include a first group of openings which are elongated, and a second group of openings which are round.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF A PREFERRED EMBODIMENT

Figure 1:
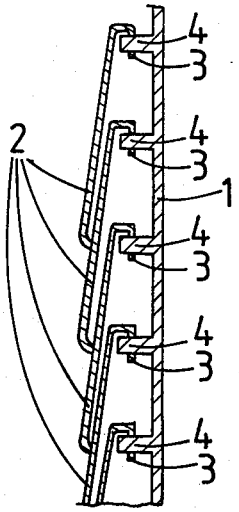
FIG. 1 is a view showing a section of wall of a transport container for transporting hot coke, in accordance with the present invention.

A transport container for transporting hot coke has a wall which is identified by reference numeral 1 in FIG. 1. The wall 1 has an inner side, and a plurality of lining plates 2 are arranged at the inner side of the wall 1.

The plates 2 are releasably mounted on the wall 1. More particularly, the plates 2 are provided with projections or pins 3 at their rear sides facing toward the wall 1, and the wall 1 is provided with a plurality of openings. Actually, the wall 1 has a plurality of strips which are identified by reference numeral 4 and provided with the above mentioned openings. The pins 3 of the plates 2 engage in the openings of the strips 4 and thereby are held in suspended condition. The strips 4 may be formed as steel strips.

FIG. 1 shows the transport container in accordance with the present invention with a typical design on its wall, wherein the plates 2 are arranged in several rows located one under the other and overlapping each other. As can be seen from FIG. 1, the plates 2 have lower edges which are rounded. It is also possible that the lower edges of the plates 2 have no roundings, but are straight and flatly abut against the neighboring plates. The plates 2 are composed, for example, of a wear-resistant cast material, such as hematite cast iron. It has been shown that this material is particularly suitable for the above described conditions of high mechanical and thermal loads in which such transport containers operate.

As shown in FIG. 1, the steel strips 4 form an integral part of the wall 1 of the container. It is, however, possible that these steel strips are formed as separate members and attached to the inner side of the wall 1 by suitable methods, such as for example welding, screwing, etc.

Figure 2:
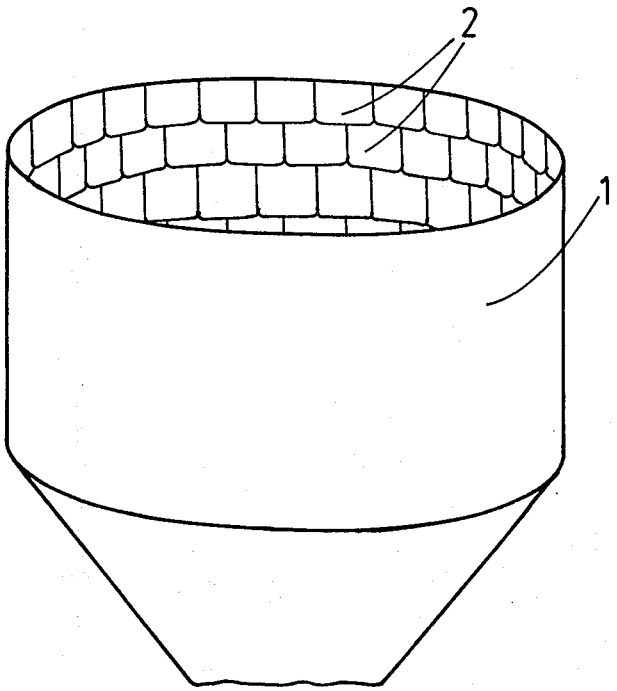
FIG. 2 is a perspective view showing a portion of the inventive transport container with a lining on its wall.

FIG. 2 shows a part of the inventive transport container and illustrates that the inner side of the wall 1 is completely coated with the plates 2. As can be seen from this Figure, the plates 2 overlap and are offset relative to one another, so that their arrangement substantially corresponds to the arrangement of shingles on a roof. It is to be understood that the shape of the transport container is not limited to the shape shown in FIG. 2.

Figure 3:
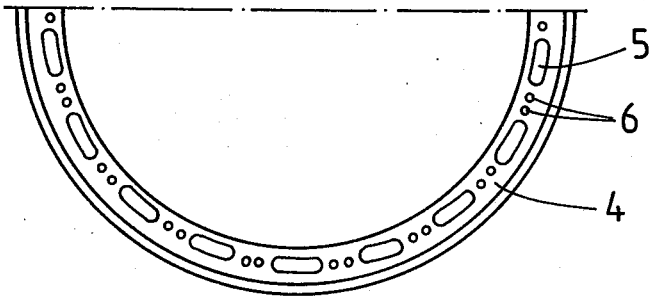
FIG. 3 is a plan view of the inventive container of FIG. 2.

FIG. 3 shows also a part of the transport container with its wall and steel strips 4 provided thereon, in plan view. As can be seen from this Figure, the strips 4 are closed, or more particularly circumferentially closed. The strips are provided with openings spaced from one another in the circumferentially direction. The openings include two different groups of openings, namely elongated openings 5 and round openings 6. The round openings 6 serve for suspending of the plates 2 with the aid of the pins 3. The elongated openings 5 are, however, provided in order to improve air circulation and heat withdrawal in the intermediate space between the plates 2 and the wall 1 of the transport container.

It is believed to be understood that the inventive construction provides for the possibility to exchange very quickly plates which are damaged during operation. In contrast to transport containers with ceramic coatings, long time periods for repair are not involved with the inventive construction.

It is also to be understood that the advantages of the present invention are not limited only to the transport containers used for transporting hot coke. The inventive transport container is also suitable for transporting other particulate materials, particularly those which involve conditions similar to the conditions of transportation of hot coke.

It will be understood that each of the elements described above, or two or more together, may also find a useful application in other types of constructions differing from the types described above.

While the invention has been illustrated and described as embodied in a transport container for transporting hot coke, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

We claim:

1. A transport container for transporting hot coke, comprising a wall bounding an inner chamber for accommodating a hot particulate material and having an inner side and a substantially upright axis; a lining arranged at said inner side of said wall and composed of a plurality of readily removable and exchangeable lining members of a material suitable for withstanding high mechanical and thermal loads; and holding means provided on said inner side of said wall and having a plurality of openings, so that each of said lining members releasably engages in a respective one of said openings and is thereby held by said holding means, said holding means including a plurality of holding members located under each other and extending in a transverse direction, said openings being formed in each of said holding members and spaced from one another in the circumferential direction.

2. A transport container as defined in claim 1, wherein said lining members are formed as lining plates.

3. A transport container as defined in claim 1, wherein said holding members of said holding means are formed as steel strips.

4. A transport container as defined in claim 1, wherein said holding members of said holding means are formed as endless closed strips.

5. A transport container as defined in claim 1, wherein said wall is formed as a body of revolution, said holding members of said holding means being formed as a circumferentially closed strips.

6. A transport container as defined in claim 1, wherein said holding means is arranged so that said lining members are held on the same in suspended condition.

7. A transport container as defined in claim 1, wherein said lining members are provided with projections engaging in said openings and arranged so that said lining members can be suspended on said holding means by said projections.

8. A transport container as defined in claim 7, wherein said lining members have a front side facing toward said inner chamber and a rear side facing toward said wall, said projections being provided on the rear side of said lining members.

9. A transport container as defined in claim 1, wherein said lining members are formed as lining plates composed of hematite cast iron.

10. A transport container as defined in claim 1, wherein said holding means are substantially horizontal strips and said openings are substantially vertical, said lining member being provided with substantially vertical projections which are insertable from above into said substantially vertical openings of said substantially horizontal strips.

11. A transport container for transporting hot coke, comprising a wall bounding an inner chamber for accommodating a hot particulate material and having an inner side; a lining arranged at said inner side of said wall and composed of a plurality of readily removable and exchangeable lining members of a material suitable for withstanding high mechanical and thermal loads; and holding means provided on said inner side of said wall and having a plurality of openings, so that each of said lining members releasably engages in a respective one of said openings and is thereby held by said holding means, said openings of said holding means including a first group of openings arranged for engagement by said lining members, and a second group of openings arranged to remain free from said lining members.

12. A transport container as defined in claim 11, wherein the openings of said first group are round, whereas the openings of said second group are elongated.

* * * * *